US009986842B1

(12) United States Patent
Belcher

(10) Patent No.: US 9,986,842 B1
(45) Date of Patent: Jun. 5, 2018

(54) PORTABLE HAND-WRAPPING PLATFORM

(71) Applicant: Allison Pia Belcher, Bronx, NY (US)

(72) Inventor: Allison Pia Belcher, Bronx, NY (US)

( * ) Notice: Subject to any disclaimer, the term of this patent is extended or adjusted under 35 U.S.C. 154(b) by 0 days. days.

(21) Appl. No.: 15/466,050

(22) Filed: Mar. 22, 2017

Related U.S. Application Data

(60) Provisional application No. 62/339,188, filed on May 20, 2016.

(51) Int. Cl.
*A47B 83/02* (2006.01)
*A47C 7/54* (2006.01)

(52) U.S. Cl.
CPC ..... *A47C 7/546* (2013.01)

(58) Field of Classification Search
CPC .. A47C 7/70; A47C 7/68; B60N 3/004; A47B 83/02
USPC ..... 297/411.21–411.29
See application file for complete search history.

(56) References Cited

U.S. PATENT DOCUMENTS 2,600,374 A 6/1952 Oneil
2,625,986 A * 1/1953 Siff ..... A47C 7/70 108/139
2,787,508 A * 4/1957 Math ..... A47B 31/06 108/47
4,575,149 A * 3/1986 Forestal ..... A47C 7/68 108/135
4,792,183 A * 12/1988 Townsend, III ..... B60N 3/004 108/27
5,140,914 A * 8/1992 Bohbot ..... A47C 7/70 108/152
5,653,499 A * 8/1997 Goodall ..... A47C 7/70 297/170
5,899,526 A * 5/1999 LaPointe ..... A47C 7/70 248/231.31
5,918,840 A * 7/1999 Christensen ..... A47B 21/0371 248/118
6,279,800 B1 * 8/2001 Lee ..... B60N 3/005 108/44
6,508,513 B1 * 1/2003 Hall ..... A47C 7/546 297/398
6,748,873 B2 * 6/2004 Brown, Sr. ..... A47B 3/10 108/49
6,899,386 B2 * 5/2005 Anton ..... A47C 7/68 297/170

(Continued)

OTHER PUBLICATIONS https://www.facebook.com/ArchAngelBoxingClub/photos/pcb.561171840747738/561171734081082/?type=3&theater.

*Primary Examiner* — Shin H Kim
(74) *Attorney, Agent, or Firm* — Keeley DeAngelo LLP; W Scott Keeley

(57) ABSTRACT

The present disclosure relates to a portable hand-wrapping platform that provides a solution for a trainer to wrap an athlete's hands. The portable hand-wrapping platform can be used by boxers, mixed martial artists, or any sports athlete for whom hand-wrapping is necessitated by the nature of a particular sport or activity. The portable hand-wrapping platform is designed to be attached to the backrest of one or two common, folding chairs. The hand-wrapping platform has a rigid bottom section that is configured to temporarily affix to either one chair back or to two chairs facing back-to-back. A padded upper surface provides a platform for an athlete to rest his forearm while a trainer wraps the athlete's hands.

12 Claims, 10 Drawing Sheets

(56) References Cited

U.S. PATENT DOCUMENTS 7,281,762 B1 * 10/2007 Getfield ..... B60N 3/004 297/163
7,900,566 B1 * 3/2011 Bunker ..... A47C 7/68 108/167
8,347,791 B1 * 1/2013 Gray ..... A47C 7/70 108/42
8,997,660 B2 * 4/2015 Satterfield ..... A47B 31/06 108/44
9,010,853 B2 * 4/2015 Motta ..... A47C 7/70 297/170
9,180,805 B2 * 11/2015 Millan ..... B60N 3/004
9,500,348 B2 * 11/2016 Callister ..... A47B 96/025
9,801,469 B2 * 10/2017 Hodge ..... A45D 44/04
9,867,459 B2 * 1/2018 Calderone ..... A47B 23/00
2004/0206277 A1 * 10/2004 Roziere ..... A47C 7/70 108/42
2006/0032417 A1 * 2/2006 Goschy ..... A47C 7/68 108/147
2006/0103180 A1 * 5/2006 Brown ..... A47C 7/70 297/162
2010/0156151 A1 * 6/2010 Smith ..... A47C 3/04 297/55
2010/0181807 A1 * 7/2010 Smith ..... A47C 3/04 297/55
2011/0031785 A1 * 2/2011 Steenson ..... A47C 7/543 297/161
2012/0248837 A1 * 10/2012 Peters ..... A47C 3/04 297/239
2012/0267923 A1 * 10/2012 Bouche ..... A47C 7/68 297/161
2013/0221710 A1 * 8/2013 Udagawa ..... A47B 83/02 297/174 R
2013/0264846 A1 10/2013 LoGrasso
2015/0069797 A1 * 3/2015 Goldberg ..... A47B 83/02 297/135
2015/0241041 A1 * 8/2015 Youngberg ..... A47B 96/025 362/249.1
2016/0000222 A1 * 1/2016 Calderone ..... A47B 23/00 297/173
2017/0056272 A1 * 3/2017 Callister ..... A47B 96/025
2017/0086592 A1 * 3/2017 Siverson ..... A47C 7/70

* cited by examiner

100

200

200

PORTABLE HAND-WRAPPING PLATFORM

CLAIM OF PRIORITY

The present non-provisional patent application claims priority to provisional patent application No. 62/339,188 having a filing date of May 20, 2016.

TECHNICAL FIELD

The presently-disclosed subject matter relates to devices used for facilitating the wrapping of the hand of a person; typically a boxer, mixed martial artist, or any sports athlete for whom hand-wrapping is necessitated by the nature of a particular sport or activity. In particular, the presently disclosed subject matter relates to devices that are portable and may be attached to the backrest of one or two common, folding chairs by means of a rigid bottom section of the device and a cushioned, flat and stable upper section of the device upon which a person's hand may be placed for the purpose of being wrapped.

BACKGROUND

Athletes involved in sport activities that involve punching commonly wrap their hands and wrists. Hands and wrists are wrapped with a cloth strip or athletic tape and gauze. A secure wrap that surrounds the wrist, palm and base of the thumb serves to maintain both the alignment of joints and to compress soft tissues to help the hand withstand the impact of a punch. Loops through the fingers prevent the wrap from sliding during use.

The hand wrap protects against several common fractures and injuries. The portion of the wrap that surrounds the thumb prevents hyper extension of the thumb joint to prevent sprain or fracture. The portion of the wrap that surrounds the palm helps keep the metacarpal bones aligned and compressed so that impact is distributed among more than one metacarpal bone at one time.

The current method of wrapping an athlete's hands commonly involves a trainer and athlete often facing each other, each sitting backwards on a chair. With the chair backs facing the athlete rests his forearm on the upper edge of the chair backs. The trainer, typically must use tape to secure a towel to the back of a chair upon which an athlete's forearms will rest while the athlete's hands are wrapped. The towel does not provide a flat, stable surface and often shifts out of place altogether, thereby rendering the method futile. This method is time-consuming, unstable and inconvenient.

Thermoforming is a process of manufacture wherein a sheet of thermos-plastic material is heated to a temperature that renders the sheet pliable. A single-surface mold may be a positive, negative or combination of both forms. Most commonly the mold is a positive protrusion placed over a flat surface. The flat surface is permeable and vacuum pressure is applied to the surface beneath the mold. The pliable sheet is placed over the mold, vacuum pressure is applied and the plastic sheet is drawn over the mold. The plastic is cooled and trimmed to create a finished part. Because the mold is a single-surface mold, the portion of the mold that is in contact with the flat surface remains an opening in the finished hollow form.

Rotational molding involves a heated hollow mold, filled with thermos-plastic material. The mold and material is heated to a the melting point of the plastic material. The mold is rotated about two axes causing the liquid material to spread evenly about the walls of the mold. The rotational motion continues through the cooling process to ensure even wall thicknesses. Rotational molding is a relatively low cost process due to the low pressure, low temperatures and inexpensive mold and setup costs.

SUMMARY

In one embodiment a portable hand-wrapping platform is designed to be used in combination with two chairs. Often common metal folding chairs are available and are the basis for the design of an example embodiment. The bottom section of a hand-wrapping platform is specifically designed to be attached to the backrest of two common, folding chairs positioned back to back, connecting the two chairs so as to allow the trainer to sit straddling one chair and facing the athlete, while the athlete to sits straddling the other chair, facing the trainer.

The hand-wrapping platform has a rigid bottom section and a padded upper surface. The rigid bottom section is configured, in one embodiment, to temporarily affix to the back rests of two chairs facing back-to-back.

In another embodiment, the rigid bottom section is configured to temporarily affix to the back rest of one chair. In this example embodiment of a portable hand-wrapping platform, the bottom section of the platform is specifically designed to be attached to the backrest of any single common, folding chair by connecting to the backrest of the chair. The trainer may straddle the chair and attend to the athlete, who faces the trainer while sitting in another chair, or the athlete may straddle the chair and be attended by the trainer, who faces the athlete while sitting in another chair.

One skilled in the art understands many chairs follow common dimensions to accommodate the anthropometric dimensions of the human body. Although no universal fit to all chairs is possible, the present disclosure describes a platform designed to fit a wide range of common chairs and their associated dimensions. Variations in the design to accommodate specific chair dimensions may be achieved without varying the scope of the invention disclosed.

A need exists for a hand-wrapping platform that can be easily transported to an athletic event, can be easy to use with a common, folding chair, and can provide a stable and comfortable platform for both the trainer and the athlete to use while the athlete rests their forearm on the platform while having their wrists and hands wrapped. These and other features and advantages of the present invention will become better understood with reference to the following brief and detailed descriptions of the drawings.

DETAILED DESCRIPTION OF THE DRAWINGS

Figure 1:
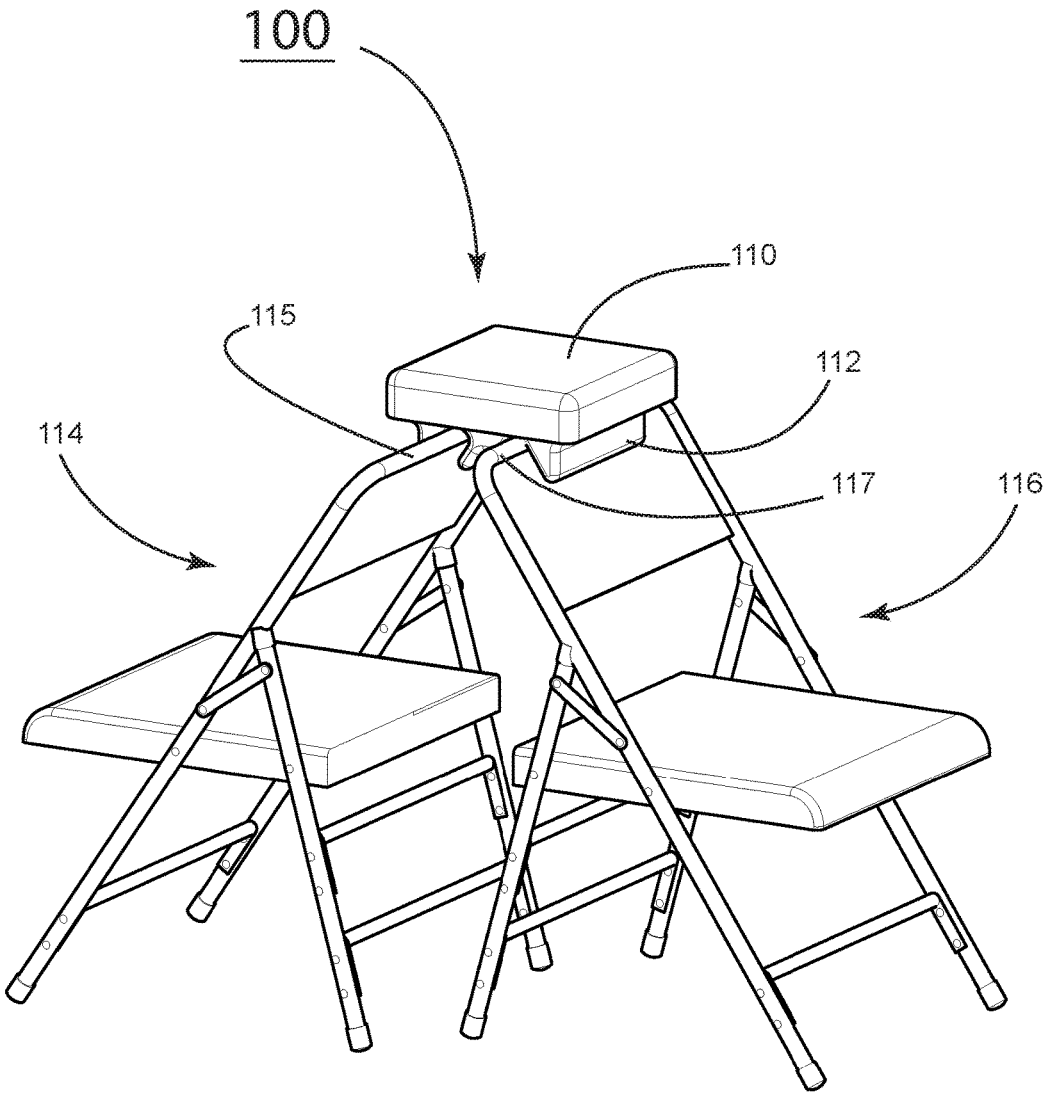
FIG. 1 is a front perspective view of an example embodiment in situ on a pair of metal folding chairs which are placed back to back.
Figure 2:
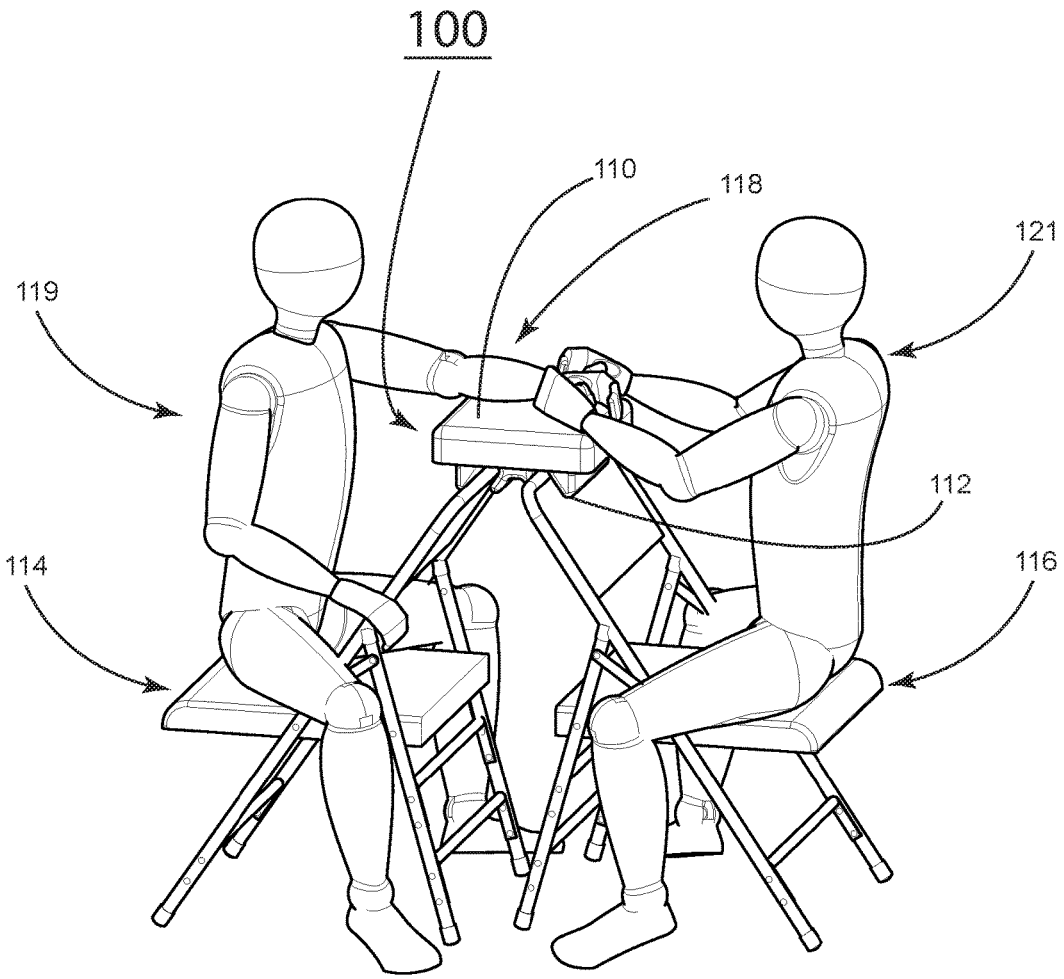
FIG. 2 is a front perspective view of an example embodiment in situ on a pair of metal folding chairs as used by a first person wrapping the wrist of a second person.

FIG. 1 and FIG. 2 are perspective front views of an exemplary embodiment of the device 100, in situ. The illustration in FIG. 1 depicts an exemplary embodiment 100 mounted on a pair of commonly available folding chairs. A first chair 114 is arranged back-to-back with a second chair 116. The embodiment 100 has a pad portion 110 and mounting structure 112. The mounting structure 112 engages with the upper edge of each chair back to create a stable platform upon which a person would rest their forearm. The mounting structure engages with the upper edge 115 of chair 114 and also engages with the upper edge 117 of chair 116.

One skilled in the art will recognize the illustration of a common metal folding chair. One skilled in the art also understands that other chairs with similar common features may be accommodated in an example embodiment of the present invention by allowing for variations in the angle of the back rest, variations in the width of the chair and the like.

The illustration in FIG. 2 depicts an exemplary embodiment of FIG. 1, mounted on a pair of folding chairs, with a first user wrapping the hand of a second user who is resting his forearm on the pad of the embodiment. The mounting structure 112 is engaged with the pair of chairs, 114 and 116 as formerly described. A first person 121 is wrapping the wrist and hand of a second person 119. The second person 119 is resting his forearm 118 on the pad 110.

Figure 3:
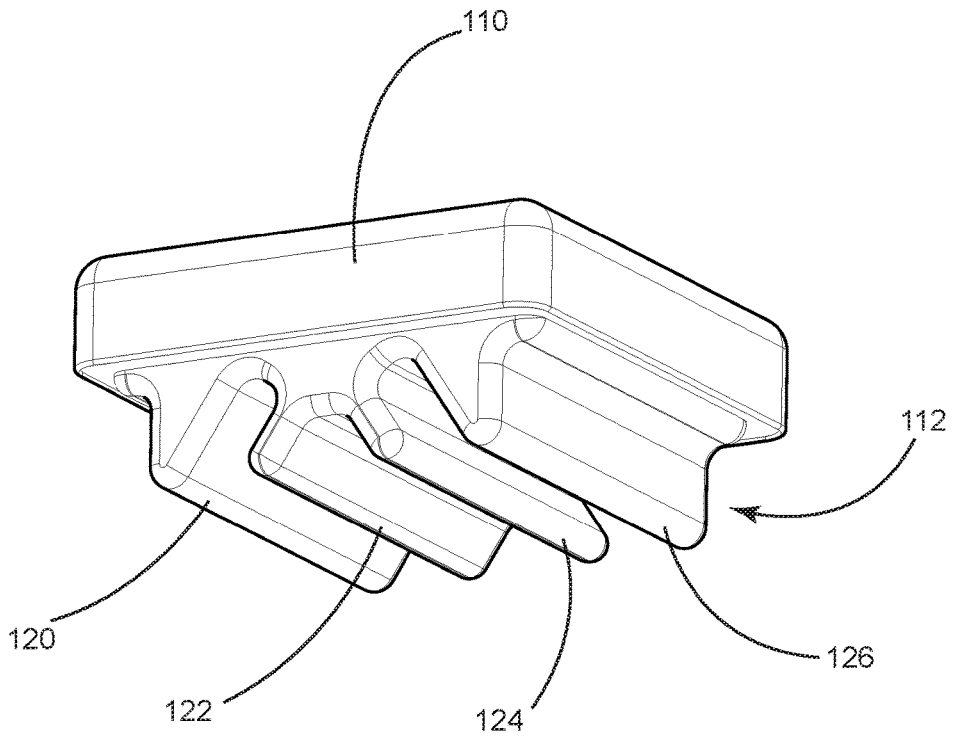
FIG. 3 is a front, bottom perspective view of an exemplary embodiment of the present disclosure.

The illustration in FIG. 3 is a bottom perspective view of the embodiment. The pad 110 is engaged with the support structure 112. The support structure comprises at least four angled, linear projections. A pair of angled, linear projections includes a first linear projection 120 that is substantially parallel to a second projection 122. A second pair of angled, linear projections is substantially a mirror projection of the first pair of angled linear projections and includes projection 126 that is configured parallel to projection 124.

Figure 4:
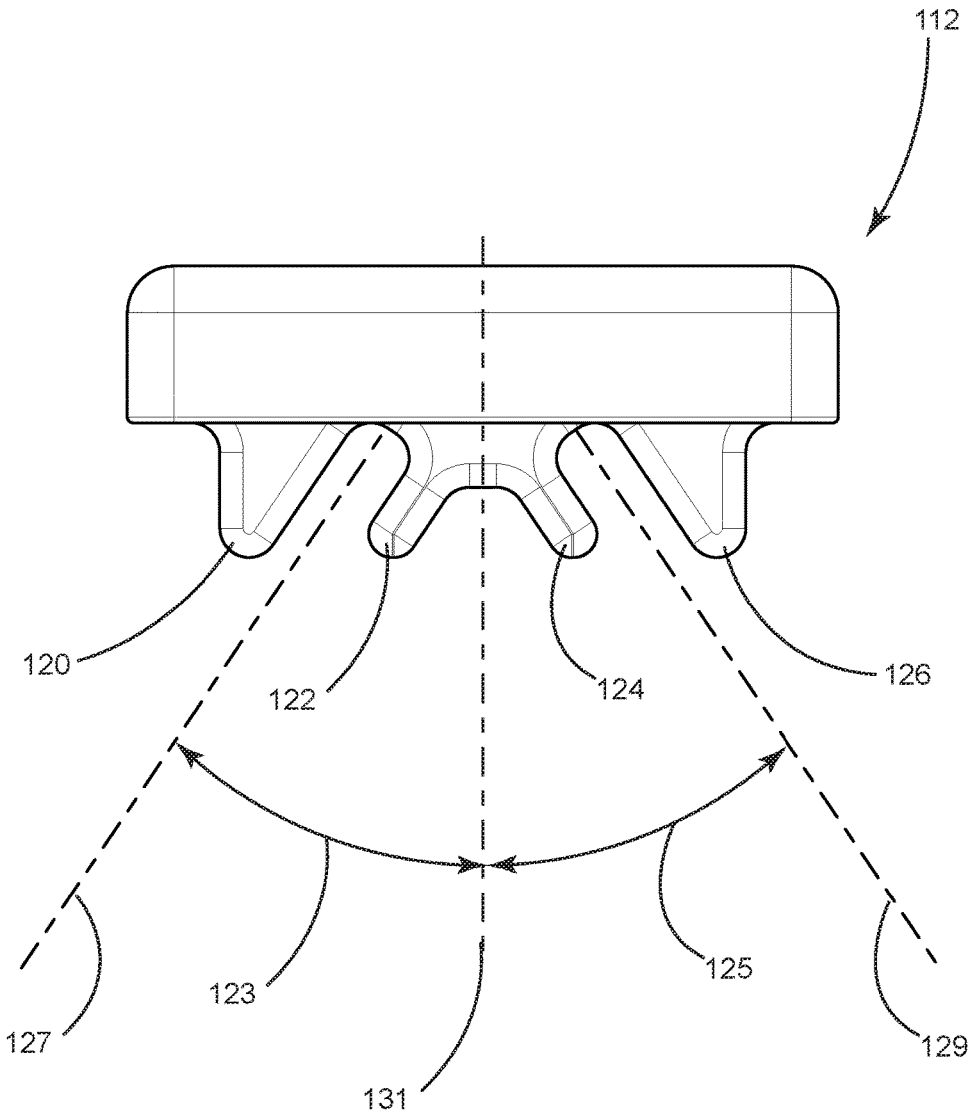
FIG. 4 is a side orthographic view of an example embodiment.

The illustration in FIG. 4 is an orthographic side view of the embodiment 100, showing the angles of the projections described in the previous paragraph. The first pair of projections 120 and 122 are parallel about a center line 127 that is at an angle 123 between 0° and 45° with respect to a vertical center line 131. The second pair of projections 126 and 124 are parallel about a center line 129 that is at an angle 125 between 0° and 45° with respect to a vertical center line 131.

Figure 5:
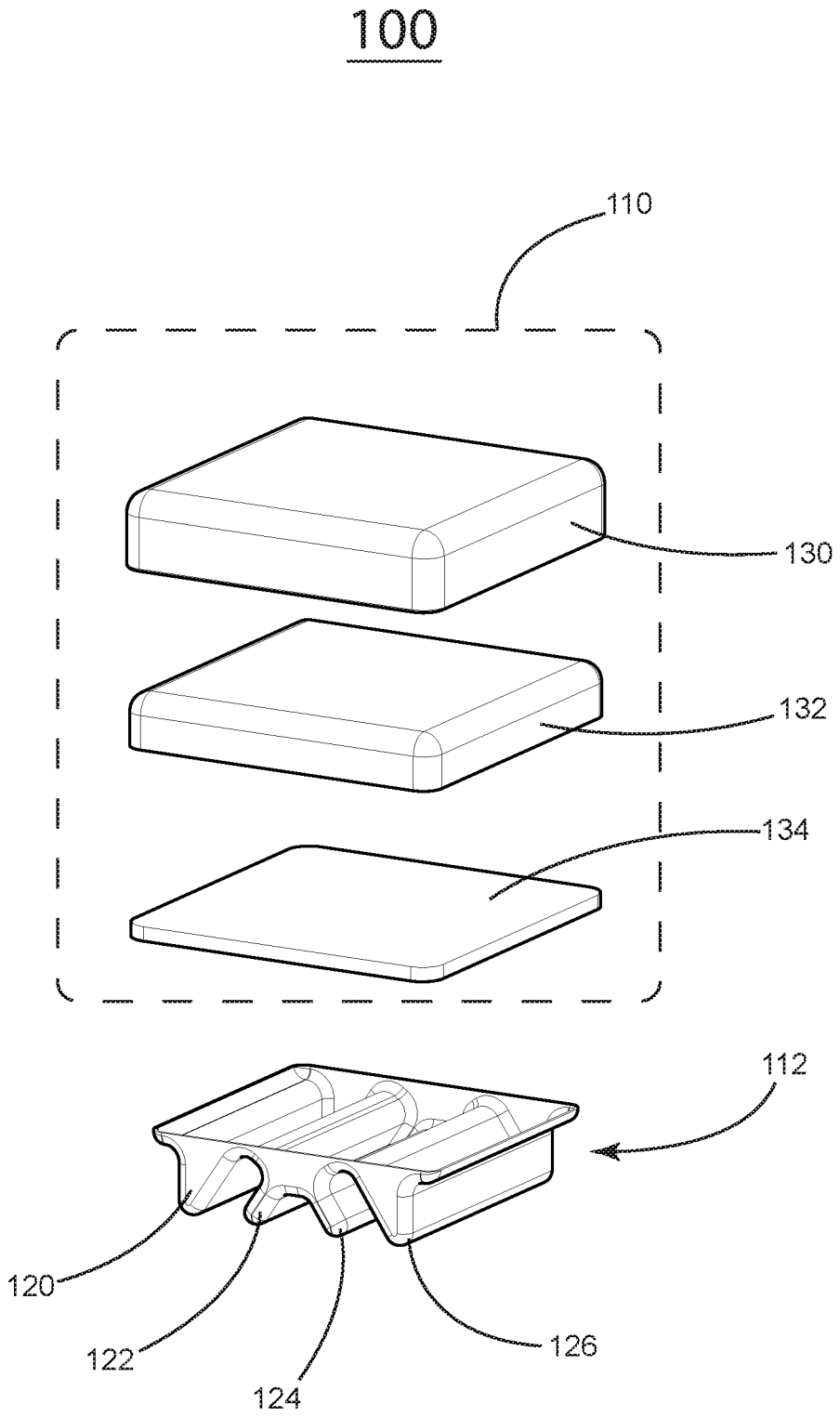
FIG. 5 is a front, perspective, exploded view of the exemplary embodiment of FIG. 3

The illustration in FIG. 5 is a front perspective, exploded view of the example embodiment 100. The assembly that comprises the pad 110 includes a rigid base 134 that is engaged with a foam structure 132 that is covered by a pad cover 130. The assembled pad 110 is engaged with support structure 112. The support structure comprises the aforementioned pairs of linear projections including pair 120/122 and 126/124.

One skilled in the art will recognize that the rigid form 112 in the illustration in FIG. 5, is hollow and has one open side with an edge that is substantially planar. One skilled in the art also understands that such a form may be manufactured by thermos-forming or vacuum forming. One skilled in the art also understands how a similar form may be constructed of a rotational molded part with the open side either closed or trimmed to remain open. One skilled in the art will also understand that a similar configuration may be constructed by co-molding an injection molded rigid lower form with an injection molded elastomeric material to create a similar end product as shown in FIG. 3.

Figure 6:
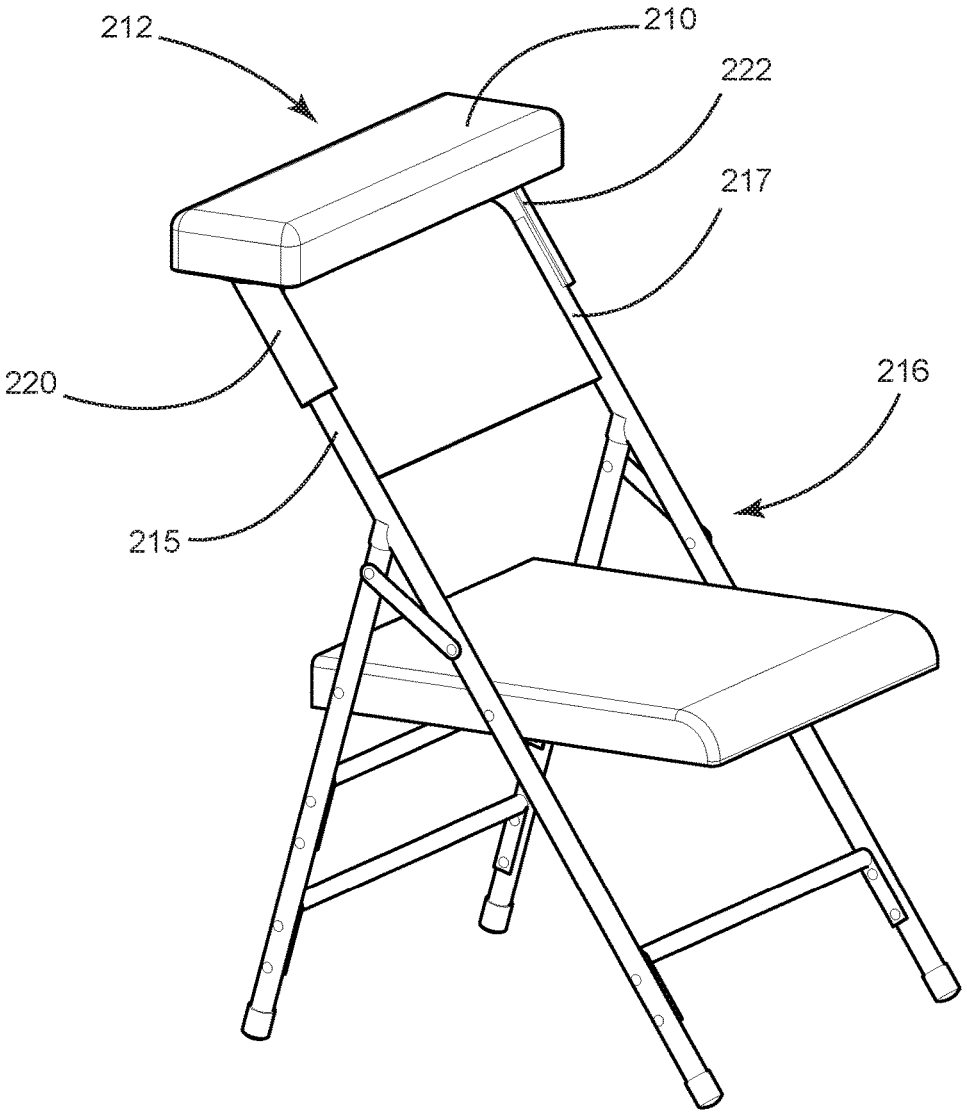
FIG. 6 is a perspective view of an iteration of the embodiment in situ on the back of a commonly available folding chair, as intended for use by a first person wrapping the wrist of a second person.

Another iteration of the embodiment 200 is illustrated in FIG. 6 through FIG. 10. The illustration in FIG. 6 depicts an exemplary embodiment 200 mounted on a commonly available folding chair 216. The embodiment 200 has a pad portion 210 and mounting structure 212. The mounting structure 212 includes at least two linear grooved arms 220 and 222 that engage with the side edges 215 and 217, respectively, of the back of a chair 216 to create a stable platform upon which a person will rest their forearm.

One skilled in the art understands that the linear grooved arms 220 and 222 may be constructed by tubular forms that are split lengthwise and enjoined with a flange to allow them to be affixed to the pad 212. One skilled in the art also understands that the pad 212 may be combined with a rigid bottom suitable for accepting fasteners for affixing the aforementioned flange.

Figure 7:
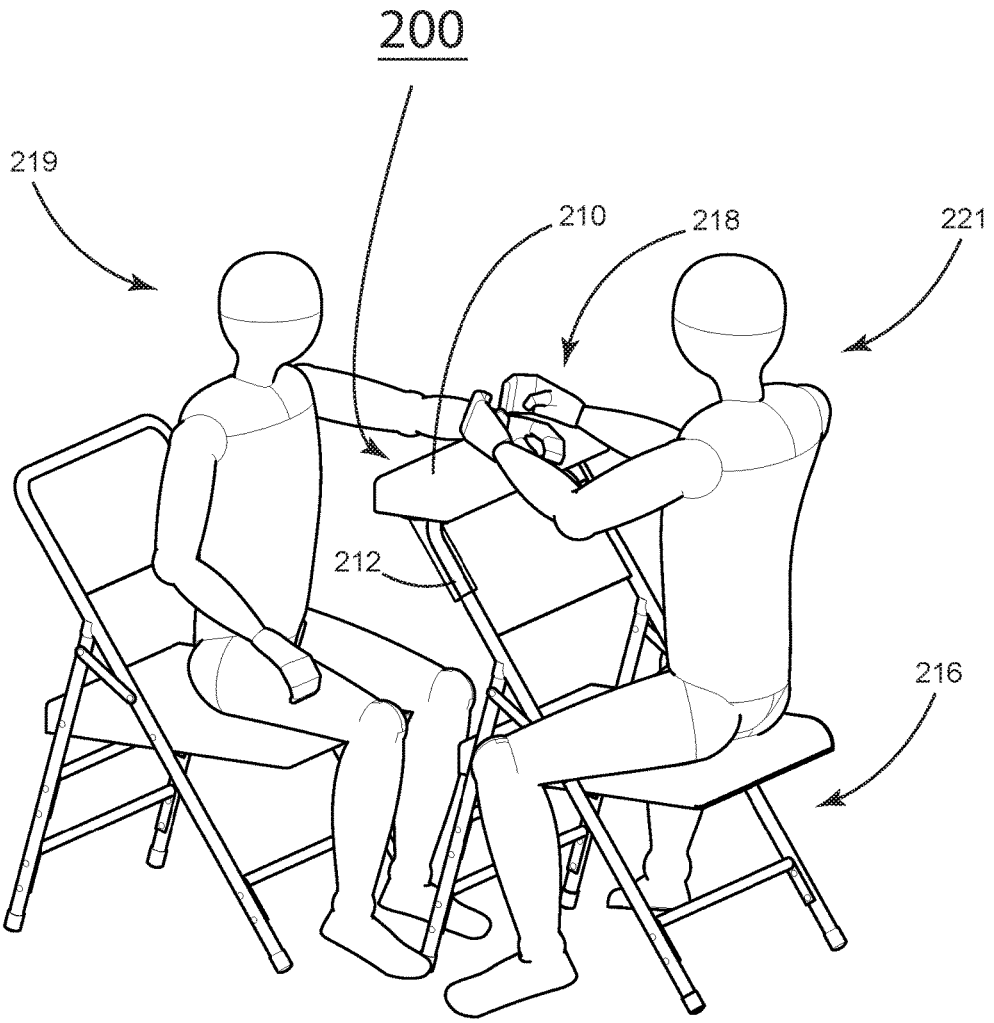
FIG. 7 is a front perspective view of the iteration of the embodiment of FIG. 6 in situ on a commonly available folding chair as used by a first person wrapping the wrist of a second person.

The illustration in FIG. 7 depicts an exemplary embodiment of FIG. 6 mounted on a folding chair, with a first user wrapping the hand of a second user who is resting his forearm on the pad of the embodiment. The mounting structure 212 is attached to the chair 216 as formerly described. A first person 221 is wrapping the wrist and hand of a second person 219. The second person 219 is resting his forearm 218 on the pad 210.

Figure 8:
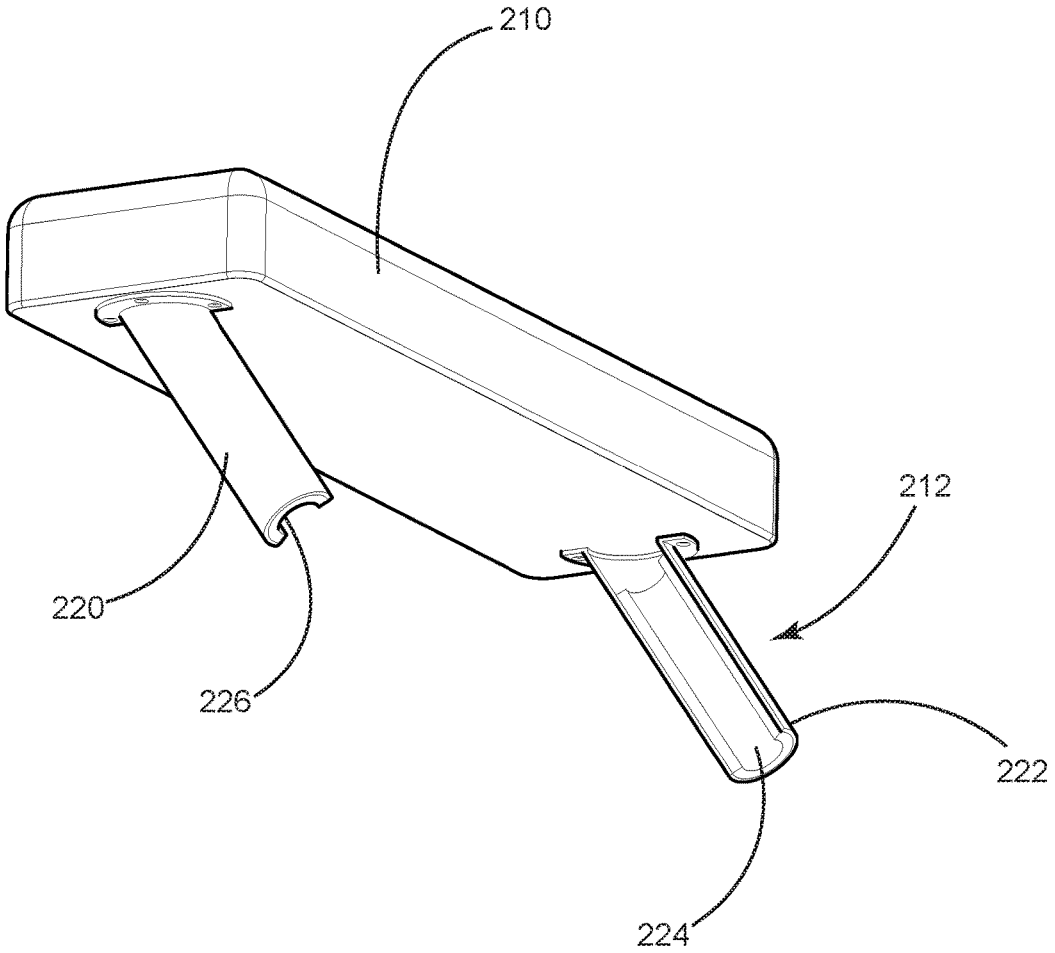
FIG. 8 is a front, bottom perspective view of the iteration of the embodiment of FIG. 6 of the present disclosure.

The illustration in FIG. 8 is a bottom perspective view of the embodiment. The pad 210 is engaged with the support structure 212. The support structure comprises at least two angled, linear grooved arms. A first grooved arm 220 is substantially parallel to a second grooved arm 222. In some embodiments each grooved arm includes a pad to assist in engagement with a chair. Grooved arm 222 has a padded lining 224, and grooved arm 220 has a padded lining 226.

Figure 9:
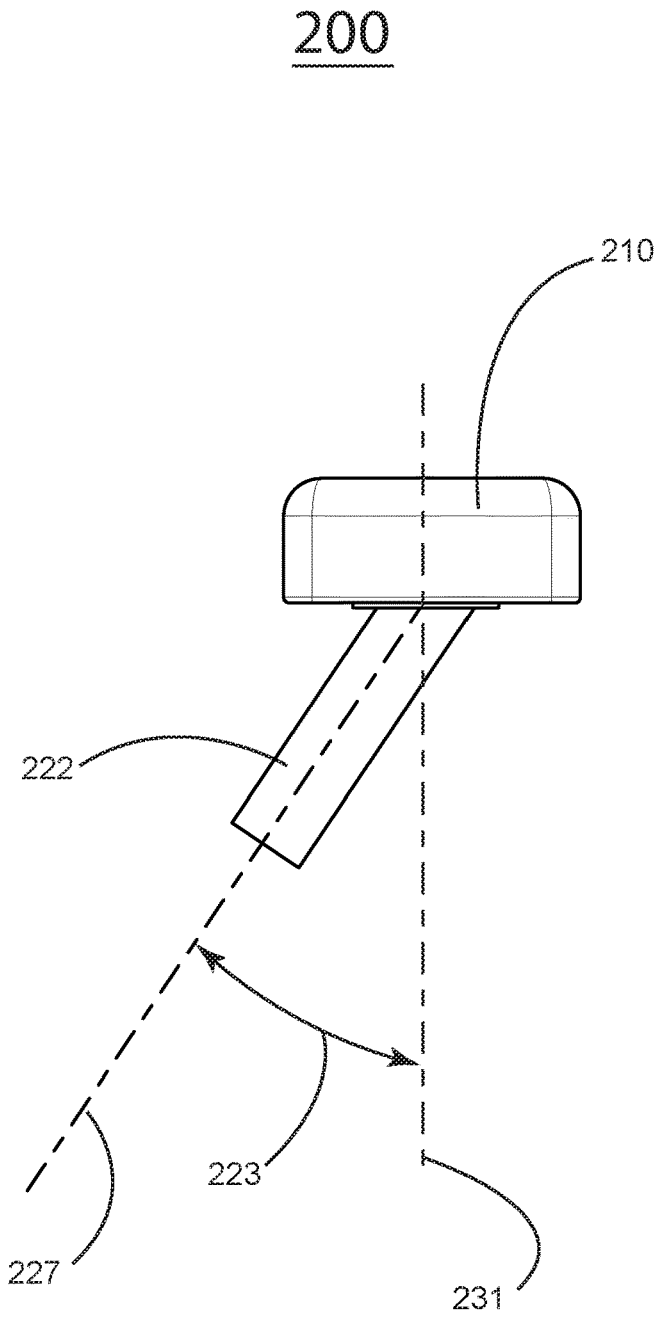
FIG. 9 is a side orthographic view of the embodiment of FIG. 6.

The illustration in FIG. 9 is an orthographic side view of the embodiment 200, showing the angles of the grooved arms. One grooved arm is shown in the orthographic projection in the illustration. One skilled in the art will understand that the opposite grooved arm is symmetrical and has substantially identical proportions and dimensions. The center line 227 of the grooved arm 222 is at an angle 223 between 0° and 45° with respect to a vertical center line 231. In other embodiments the grooved arm 222 is at an angle 223 between 10° and 35° with respect to a vertical center line 231

Figure 10:
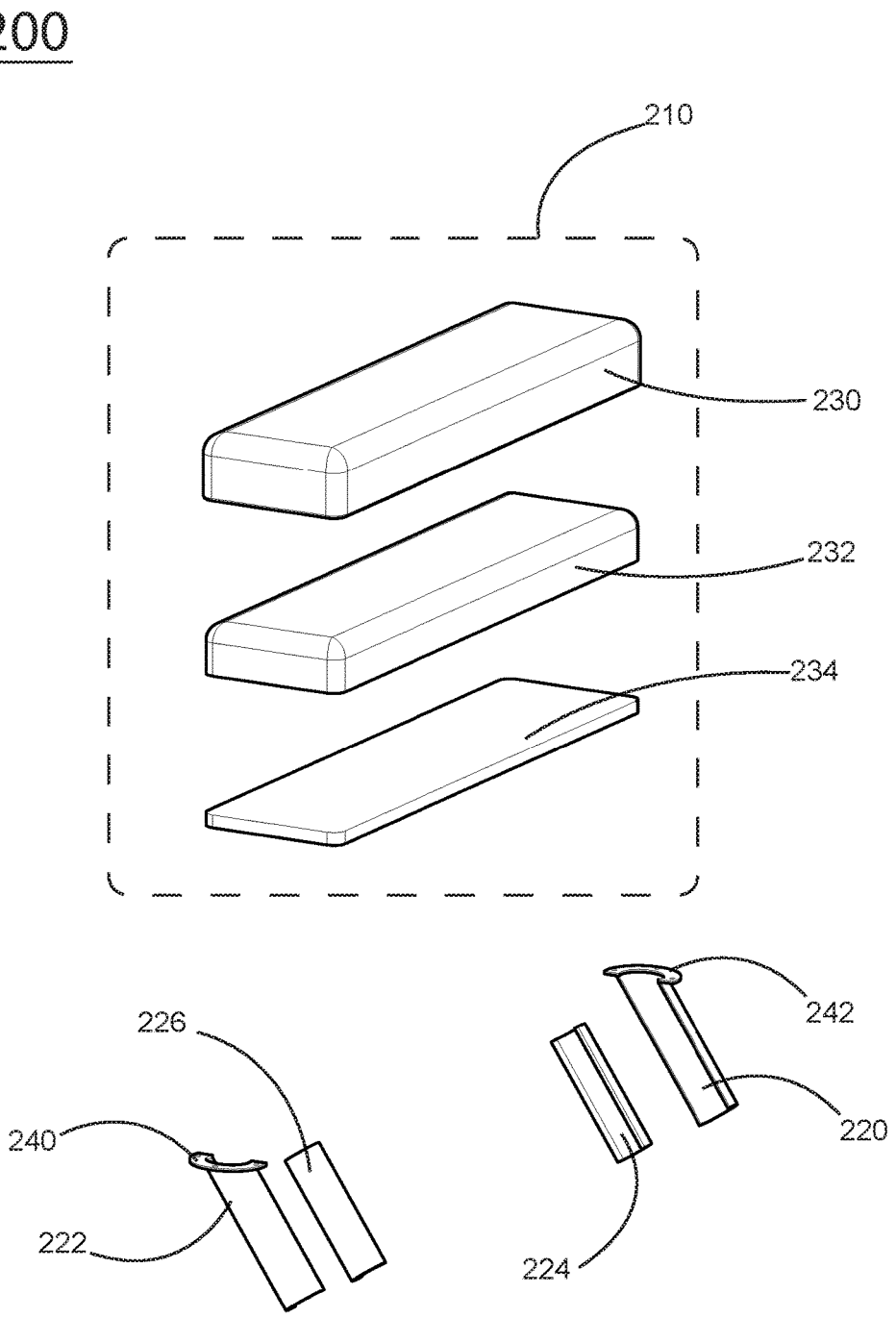
FIG. 10 is a front, perspective, exploded view of the iteration of the embodiment of FIG. 6.

The illustration in FIG. 10 is a front perspective, exploded view of the example embodiment 200. The assembly that comprises the pad 210 is includes a rigid base 234 that is engaged with a foam structure 232 that is covered by a pad cover 230. The assembled pad 210 is engaged with support structure FIG. 8, 212. The support structure comprises the aforementioned pairs of linear grooved arms. A first grooved arm FIG. 10 220 is designed with a flange 242 for engaging the rigid base 234 and is further engaged with a semi-rigid lining 224 for attaching to the back of a chair. A second grooved arm 222 is has a flange 240 for engaging the rigid base 234 and is further engaged with a semi-rigid lining 226 for attaching to the back of a chair.

One of ordinary skill in the art will understand that the flanges 240 and 242 may be flanges or brackets or hinged flanges or brackets or other common hardware for engaging legs to horizontal surfaces.

One of ordinary skill in the art will recognize that additional embodiments are also possible without departing from the teachings of the presently disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

The invention claimed is:

1. An apparatus providing a platform for resting an athlete's forearm up on while the wrist and hand of the forearm are wrapped by another comprising:

a rigid lower form; and said rigid lower form having at least one slot; and said rigid lower form fixedly engaged with a padded upper form; and providing a chair with a backrest having two sides and a top edge; and said at least one slot configured to receive the top edge of the backrest of said chair;

wherein the slot of said rigid lower form being engaged with the top edge of the backrest of said chair, supports the padded upper section in an orientation that is comfortable for one to rest a forearm on when sitting on the chair facing the backrest.

2. The apparatus of claim one further comprising:

two of said at least one slot; and the rigid lower form being rectangular having long sides parallel to the backrest of said chair; and providing a vertical plane that is parallel to said long sides of said rectangle, and about which said slots are symmetrical; and said slots are at an angle to said plane, between 0° and 45°; wherein said slots are coplanar with the backs of two chairs when said chairs are placed back-to-back such that a first person and a second person sitting on said chairs each facing the backrest of the chair they are sitting in and each facing each other, the first person resting a forearm on said padded surface places said forearm and wrist in an appropriate position for said second person to wrap the hand and wrist of the first person.

3. The apparatus of claim two wherein said slots are at an angle to said vertical plane between 10° and 35°.

4. The apparatus of claim one further comprising:

said rigid form being constructed of rotational molded plastic; and said rigid form having a flat top-surface; and a planar surface engaged with said flat top-surface of the rigid form; and a foam polyurethane pad engaged atop said planar surface; and a replaceable fabric cover is removably engaged with said pad; wherein the replaceable cover may be removed for washing.

5. The apparatus of claim one further comprising:

said rigid form being constructed of thermos-formed and having an one open side; and a planar surface engaged atop the one open side of said rigid form; and a foam polyurethane pad engaged atop said planar surface; and a replaceable fabric cover is removably engaged with said pad; wherein the replaceable cover may be removed for washing.

6. The apparatus of claim one further comprising:

said rigid form being constructed of injection molded plastic; and said rigid form having a flat top-surface; and a foam polyurethane pad co-molded proximal to said flat top-surface surface.

7. A method of manufacturing an apparatus for providing a platform for an athlete to rest a forearm on while the wrist and hand of said forearm are wrapped with tape comprising:

forming a lower rigid component by thermoforming sheet plastic over a single-surface mold thus creating a formed lower rigid component; and trimming said formed lower rigid component from thermoformed sheet, leaving an open side, and fixedly engaging a rigid planar surface material to the open end of said formed lower rigid component; and fixedly engaging padding to said rigid planar surface material; and upholstering said padding.

8. A method of wrapping an athlete's wrist and hand, the method comprising:

providing the apparatus of claim one; and providing a first person and a second person; and engaging the at least one slot with the top edge of a backrest of a chair; and said first person sitting in a chair facing the backrest of said chair; and said second person at eye-level with said first person; and said second person wrapping the wrist and hand of said first person.

9. An apparatus for providing a platform for an athlete to rest a forearm on while the wrist and hand of said forearm are wrapped comprising:

providing a chair having a backrest, said backrest being rectangular having two vertical, short sides and two horizontal, long sides one above the other; and a first tubular form split lengthwise; and a second tubular form split lengthwise; and a rectangular rigid planar surface having a top and a bottom and a central plane parallel to the short sides of said rectangle and midway between said short sides; and said first tubular form and said second tubular form engaged with said bottom surface of said rectangular rigid planar surface, symmetrically about said central plane; and said first and second tubular forms configured at an angle that is substantially parallel with the short-vertical sides of said backrest of said chair; and said rigid planar surface top engaged with a pad; and said pad is removably engaged with a washable fabric cover; wherein removably engaging said first and second tubular forms with the vertical short sides of a backrest of a chair provides a padded surface suitable for resting one's forearm on while one is sitting in the chair while facing the backrest.

10. The apparatus of claim nine wherein the first and second tubular forms are configured at an angle that is between 0° and 45° with respect to a vertical axis.

11. The apparatus of claim nine wherein the first and second tubular forms are configured at an angle that is between 10° and 35° with respect to a vertical axis.

12. A method of wrapping an athlete's wrist and hand, the method comprising:

providing the apparatus of claim nine; and providing a first person and a second person; and engaging the first tubular form split lengthwise, with the a side of a backrest of a chair; and simultaneously engaging the second tubular form split lengthwise, with an opposite side of a backrest of a chair; and said first person sitting in said chair facing said backrest of said chair; and said second person at eye-level with said first person; and said second person wrapping the wrist and hand of said first person.

* * * * *